US008105130B2

(12) United States Patent
Fildan et al.

(10) Patent No.: US 8,105,130 B2
(45) Date of Patent: Jan. 31, 2012

(54) INLAY FOR THE RESILIENTLY SHAPE-MAINTAINING REINFORCEMENT OF BRA CUPS

(75) Inventors: Gerhard Fildan, Vienna (AT); Karl Wanzenboeck, Teesdorf (AT)

(73) Assignee: Fildan Accessories (HK) Ltd, Kwun Tong Kowloon (HK)

( * ) Notice: Subject to any disclaimer, the term of this patent is extended or adjusted under 35 U.S.C. 154(b) by 453 days.

(21) Appl. No.: 12/362,614

(22) Filed: Jan. 30, 2009

(65) Prior Publication Data

US 2009/0197509 A1 Aug. 6, 2009

(30) Foreign Application Priority Data

Jan. 31, 2008 (DE) ..... 10 2008 007 068

(51) Int. Cl.
*A41C 3/00* (2006.01)

(52) U.S. Cl. ..... 450/41; 450/52

(58) Field of Classification Search ..... 450/41, 450/43, 47, 49, 51, 52, 53, 55, 56, 39, 40; 2/255, 256, 258, 259, 264
See application file for complete search history.

(56) References Cited

U.S. PATENT DOCUMENTS

| | | | | |
|---|---|---|---|---|
| 2,595,088 | A * | 4/1952 | Licht | 450/52 |
| 3,562,802 | A * | 2/1971 | Avis | 450/52 |
| 6,346,028 | B1 * | 2/2002 | Fildan et al. | 450/41 |
| 6,447,365 | B1 * | 9/2002 | Powell et al. | 450/41 |
| 7,234,994 | B2 * | 6/2007 | Fildan et al. | 450/41 |
| 7,377,833 | B1 * | 5/2008 | Wanzenboeck et al. | 450/54 |
| 7,390,239 | B1 * | 6/2008 | Huang | 450/39 |
| 7,429,205 | B1 * | 9/2008 | Huang | 450/39 |
| 7,458,877 | B2 * | 12/2008 | Yu | 450/39 |

* cited by examiner

*Primary Examiner* — Gloria Hale
(74) *Attorney, Agent, or Firm* — Andrew Wilford

(57) ABSTRACT

An inlay for reinforcing a bra cup is a pliably resilient plastics material part having the basic shape of a crescent with inner and outer edges that are curved and that have a spacing that increases continuously between a minimum value at one end and a maximum value at an opposite end. A rigidity of the inlay decreases from the outer edge to the inner edge. The inlay is manufactured flat such that a central face running between wide delimiting faces lies in a plane. The inlay is made of a material that is plastically deformable under the action of temperature for form-fitting or material-to-material connection to the textile material layers of the cups.

8 Claims, 3 Drawing Sheets

INLAY FOR THE RESILIENTLY SHAPE-MAINTAINING REINFORCEMENT OF BRA CUPS

FIELD OF THE INVENTION

The present invention relates to an inlay for the resiliently shape-maintaining reinforcement and stabilizing of bra cups, the regions of which directly adjoining the wearer's chest are intended to have higher rigidity than in the remaining region of the cups, and having regions directly engaging a wearer's thorax and intended to have higher rigidity than cup regions that encase the wearer's breasts and are of a convex/dome shape, the inlay being connected in a material-to-material or form-fitting manner to a limp/flexible textile material that otherwise forms the bra cups.

BACKGROUND OF THE INVENTION

For the above-described purpose, it is known to reinforce edge regions lying against the wearer's thorax of the bra cups using foil-shaped inlays that are embedded between textile material layers of the cups and/or to insert into the respective breast-supporting edge regions of the cups for stabilizing purposes substantially rubbery/resilient three-dimensional supporting parts that nestle to the body shapes, into the cup edges to support the shaping properties thereof.

In the case of inlays of this type, it may, insofar as the inlays are foil-shaped, flexurally resilient parts, be regarded as a drawback that parts of this type are, irrespective of a relatively high flexibility with respect to a predefined bending axis running for example at right angles to edges, running substantially parallel, of the inlay, after such bending nevertheless stiffened against bending in other directions, so deformation range to an adaptation that is comfortable for the wearer, of the cup shape to the body shape and therefore very close attention must be paid to the shaping of the inlays during the manufacture of bras. The consequence is then that a large number of inlays of various designs must be kept in stock.

This is all the more so if three-dimensionally configured, for example rubbery-resilient, bodies are used as cup reinforcement, as in this case the two cups generally require differently configured inlays that must be configured mirror-symmetrically with respect to the plane of symmetry of the wearer's body. This in itself can be very expensive.

OBJECT OF THE INVENTION

The object of the invention is therefore to provide an inlay of the type mentioned at the outset allowing, while still being able to be manufactured simply and economically, a comfortable, adaptable configuration of the bra cups.

SUMMARY OF THE INVENTION

According to the invention, this object is achieved, in terms of the basic idea in that the inlay is embodied as a resiliently shape-maintaining plastics material part having the basic shape of a crescent with edges curved in an arcuate manner at least in certain portions, wherein the crescent tip is as it were cut-off and the spacing of the arcuate edges of the inlay varies constantly between a minimum value at one end of the crescent portion and a maximum value at the other end of the crescent portion.

Simply this shaping of the inlay according to the invention facilitates—at a predefined thickness of the plastics material part—resilient bending about various axes and as a result increases the comfort of the bra wearer.

Furthermore, provision is made for the flexural rigidity of the inlay to decrease from its relatively less markedly curved edge that rests against the thorax in the use configuration of the bra, inward, i.e. toward the breast-side edge having the relatively smaller radius of curvature, the inlay being present, in the starting configuration for the manufacture of the bra, as a flat shaped part, in such a way that the contours of a central face, running between the two extensive delimiting faces, run in a plane; this, on the one hand, further benefits, owing to the increased flexibility on the breast side, wearer comfort and, on the other hand, reduces the costs required for manufacturing the bra, as both the left and the right cup of the respective bra can be produced with inlays shaped in the same way; this is less expensive. This is all the more so if is provision is also made to use for the inlay a material that is plastically deformable under the action of temperature, so that it is possible to apply, for form-fitting and/or material-to-material connection to the textile material layers of the respective cup and for the actual shaping thereof, an operation in the manner of a deep-drawing process, allowing inexpensive, high-quality manufacture of the bra.

Examples of materials that are in this regard suitable for the inlay and allow manufacture thereof by injection-molding include polyurethane or a thermoplastic silicone material for high quality requirements. It is possible by a decrease in material thickness from the outer edge to the or provision of openings in a predetermined distribution, shape or size to achieve a comfortable rigidity or flexibility profile of the inlay according to the invention.

If there is provided the edge having the greater radius of curvature, of the inlay a strip-shaped edge region that can be angled relative to the cup via a material constriction imparting the property of a film hinge, then this strip-shaped edge region can in use of the bra rest flat against the wearer's thorax; this leads to a distribution that is advantageous for wearer comfort of the holding forces that fix the bra to the body and generated for example by resilient prestressing of fixing elements and are intended to hold the bra in a manner that is reliably secure but gentle on the wearer in the wearing configuration.

In conjunction therewith, it is advantageous if the inlay edge region that can be placed against the wearer's thorax has significantly higher strength or rigidity than the adjoining crescent-shaped region of the inlay; this can be achieved in a simple manner according to the invention by means of a wire or flat rod-shaped reinforcing bow that is surrounded by the plastics material of the inlay by being injection molded into the inlay.

Alternatively thereto, reinforcement of the edge region of the inlay can also be achieved by a wire braid that is configured in a comparatively flat manner and can be sheathed with plastics material during manufacture of the inlay by injection-molding.

In an expedient configuration of the cup inlays, the inlays are, in the case of a circular arcuate or approximately circular arcuate configuration of their edge strips, configured in such a way that they extend, viewed in the use configuration, over angular ranges of at least 150° and at most 280°, preferably angular ranges between 240° and 270°, preferably in such a way that their end portions facing the body plane of symmetry run at right angles or almost at right angles to the plane and the portions, associated with the respective breast exterior, of the support edge strips that point toward the wearer's shoulder region, run flat at an acute angle or approximately parallel to the above-described body plane of symmetry.

Overall, it may be stated that, in the case of the inlay according to the invention, the requirements for a shape-maintaining stiffening of the cups of a bra, on the one hand, and the edge reinforcement thereof, which would otherwise require for example a wire bow, on the other hand, can be met by means of a single, substantially one-piece plastics material part that can be manufactured in a single operation, as an injection-molded part, and can be produced with high quality, although cost-effectively, and is in addition distinguished, owing to its pliability that differs in certain regions, and stiffening as required, also by high wearer comfort.

BRIEF DESCRIPTION OF THE DRAWING

Further details of the inlay according to the invention will emerge from the subsequent description of specific illustrated embodiments with reference to the drawings, in which.

DETAILED DESCRIPTION

Figure 1:
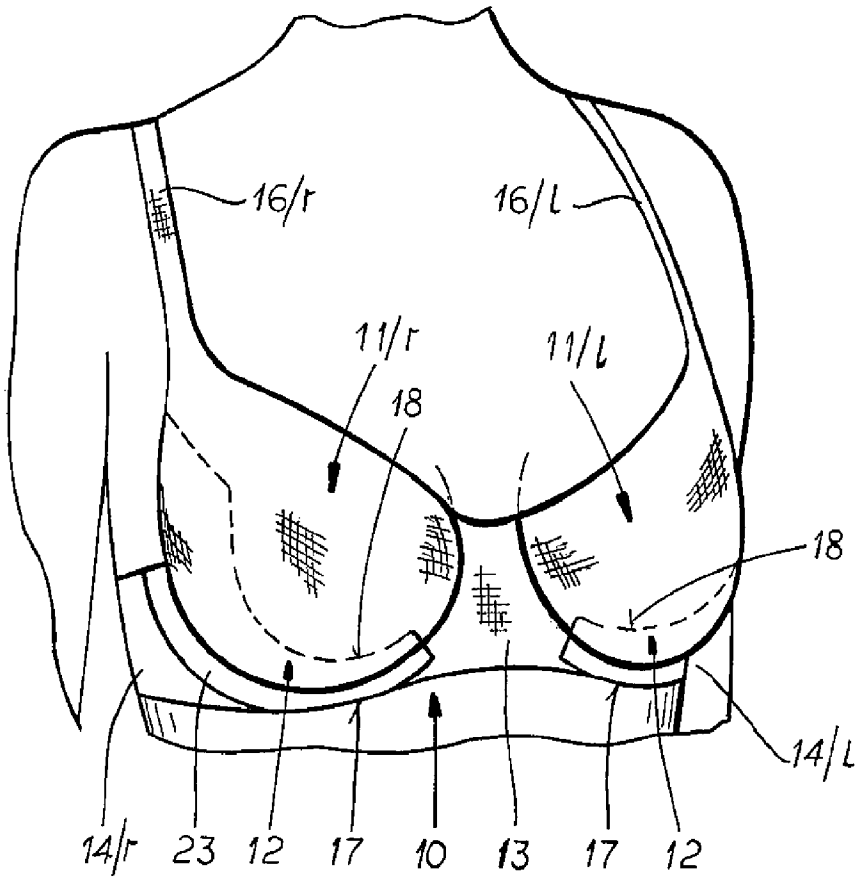
FIG. 1 is a schematically simplified, perspective view of inlays according to the invention for the resiliently shape-maintaining stabilizing of cups of a bra, in the configuration thereof supporting the wearer's breast.

In the case of the bra denoted as a whole in FIG. 1 by reference numeral 10, the cups 11/*l* and 11/*r* respectively thereof are provided with inlays 12 according to the invention that in FIG. 1 are illustrated merely by broken lines and impart to the two cups 11/*l*, 11/*r* a resiliently shape-maintaining-stabilizing-function with respect to the wearer's décolleté neckline.

These inlays 12 are embedded into the layered structure of the cups 11/*r*, 11/*l* for example between an inner-body-side-textile material structure and an outer textile material layer that are joined together in a conventional manner, for example by seams or by material-to-material connections by means of temperature-assisted bonding or fusing of an overall laminated structure of the cups 11/*l*, 11/*r* and of the bra 10 as a whole.

For the bra 10, a conventional configuration will—for the purposes of description and without restricting generality—be assumed, be such that the two cups 11/*l* and 11/*r* are joined together by a web 13 that nestles in the illustrated wearing configuration of the bra 10 in the region of the wearer's breast bone, against her thorax, whereas side parts 14/*r* and 14/*l* that lead further away from the cups 11/*l, r* of the bra 10 laterally surround the wearer's thorax and can be joined together on their back by a conventional closure. The straps 16/*r* and 16/*l* of the bra are also each connected to the left or right side part 14/*l* or 14/*r* of the bra in a manner not illustrated.

The inlays 12/*l*, 12/*r* are made of thermoplastic polymer material and are manufactured as injection-molded parts that are embodied in a starting configuration as flat parts and are shaped in a deep-drawing process in which the inlays 12/*l*, 12/*r* are also connected to the cups 11/*l*, 11/*r* in a material-to-material and preferably also form-fitting, shape-maintaining manner.

In this case, the cups are inserted into a concave female mold and shaped by means of a male punch that urges the cup/inlay composite structure into the concave female mold, in such a way that the desired dome shape of the cups and the cup regions that are stabilized by the inlays is achieved and remains stable after curing of the thermoplastic components thereof.

For this purpose, the inlays 12, which have the resiliently shape-maintaining effect with respect to the cups 11/*l*, 11/*r*, are in specific configurations embodied more specifically as follows:

The inlays 12, for the detailed description of which reference will now be made to FIGS. 2 and also 3*a* and 3*b*, are embodied, before their shape-configuring incorporation into the cups 12 of the bra 10 takes place, as identical, flat parts each of whose basic shape may be inferred from the plan view of FIG. 2 in details for a specific illustrated embodiment.

Figure 2:
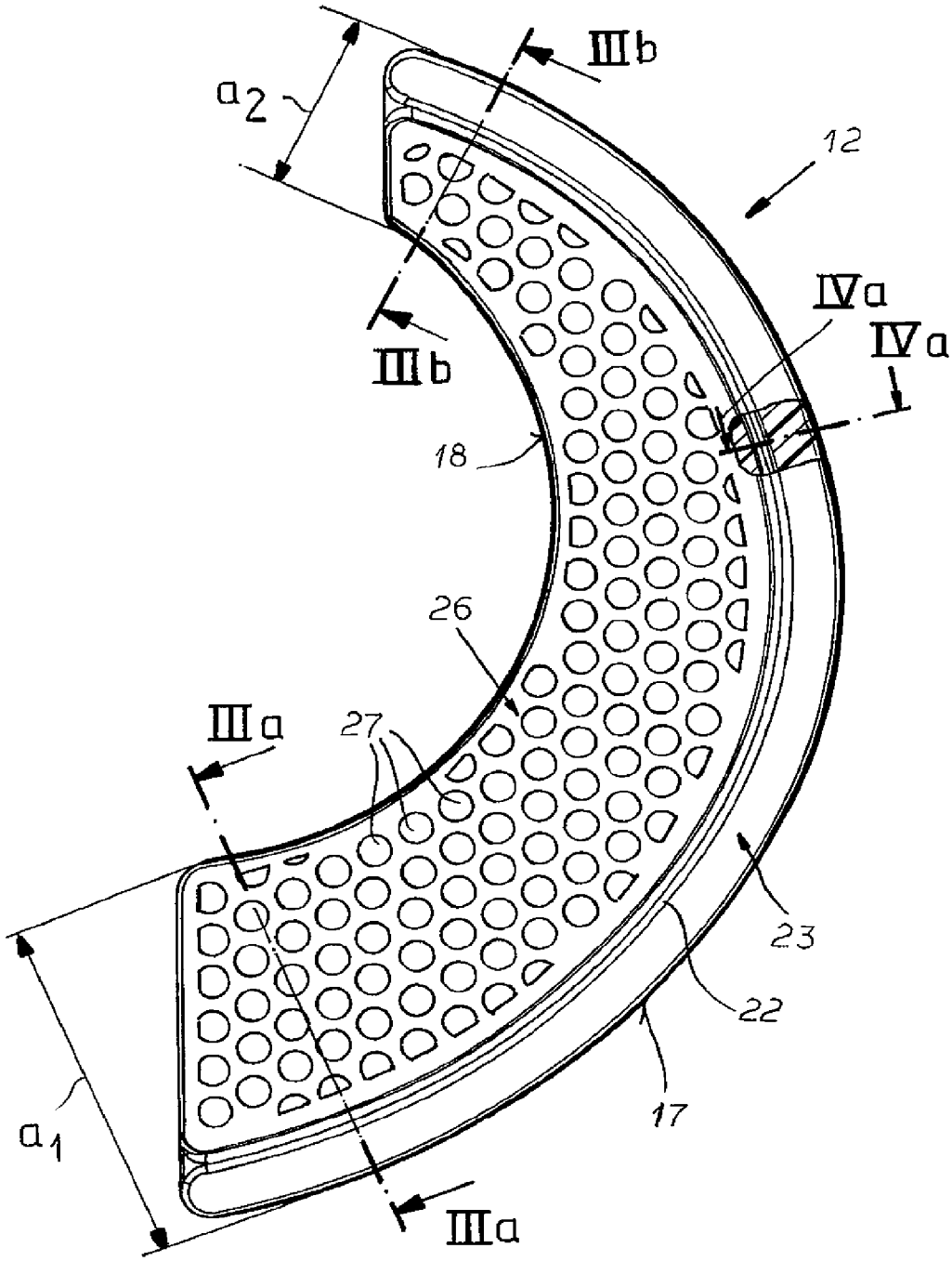
FIG. 2 shows, on a 1:1 scale, one of the inlays of the bra according to FIG. 1 in a flat configuration that is provided prior to insertion into a respectively associated cup and in which the contours of the outer delimiting faces run substantially in each case in a plane.
Figure 3B:
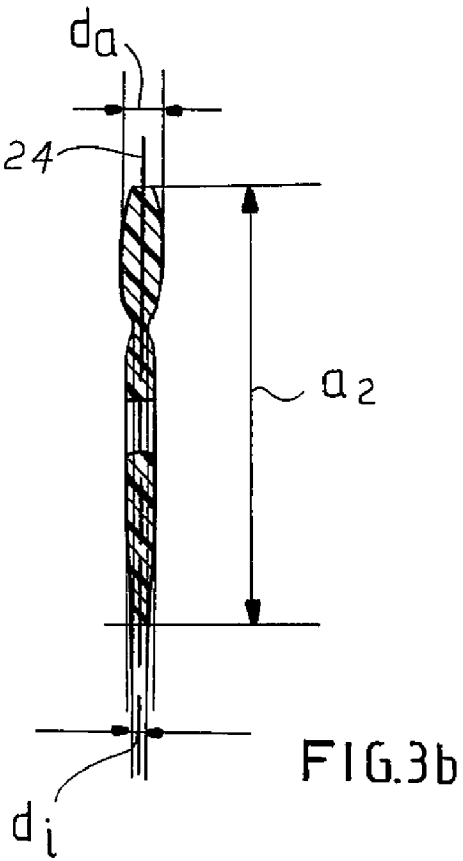
FIG. 3*b* shows the inlay according to FIG. 2 in a section along the line IIIb-IIIb of FIG. 2.
Figure 3A:
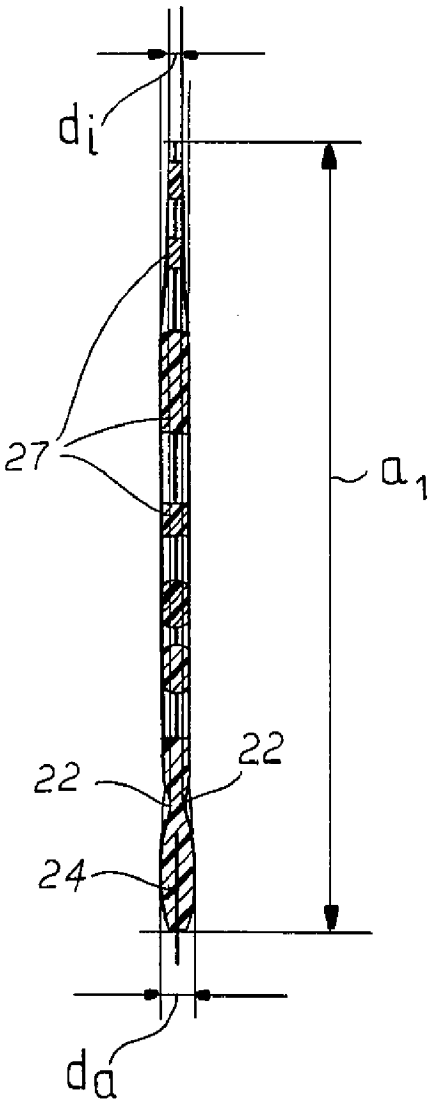
FIG. 3*a* shows the inlay according to FIG. 2 in a section along the line IIIa-IIIa of FIG. 2.

The inlay 12 according to FIGS. 2, 3*a* and 3*b* has the basic shape of a crescent with an outer edge 17 that is curved in an approximately circularly arcuate manner and has an average radius of curvature of approximately 105 mm and an inner edge 18 that is also curved in an approximately circularly arcuate manner and whose radius of curvature is, at approx. 60 mm, significantly smaller than that of the outer edge 17.

The position of the curvature center points of the inner edge 18 and of the outer edge 17 and the respective radii of curvature are, in the case of the specific illustrated embodiment illustrated in FIG. 2, adapted to one another in such a way that, viewed in the sectional planes IIIa-IIIa, on the one hand, and IIIb-IIIb, on the other hand, the ratio a1/a2 of the widths a1 and a2, measured at right angles to the outer edge 17, at the wider end of the inlay and at the narrow end of the inlay 12 has a value of about 2, the wider end front edge 19 of the inlay 12 and the narrower end front edge 21 running parallel to each other.

In this case, only the wider end front edge 21 runs approximately radially and extends along a straight line passing through the curvature center point of the outer edge 17, while the other—narrower—end front edge runs relative to the outer edge 17 at an angle that is significantly smaller than 90°. The inlay 12 extends, viewed in the circumferential direction of the outer edge 17 of the inlay according to FIG. 2, over an angle of approximately 175°.

The above-described dimension particulars are to be understood as guide values that may be representative of an average bra size.

The inlay 12 is configured in such a way that its shapeability—pliability—varies constantly between the outer edge 17 and the inner edge 18 in such a way that the rigidity of the inlay 12 is much lower near the inner edge 18 than near the outer edge 17.

For this purpose, the inlay 12 is on the one hand configured in such a way that its thickness decreases toward the inner edge 18, thus producing in the section planes III/a-III/a and III/b-III/b the flat, acute-angled shapes that may be seen in FIGS. 3*a* and 3*b*, wherein in the region of the outer edge 17 the material thickness $d_a$ has a value of about 2.5 mm and in the region of the inner edge the material thickness $d_i$ has a value of about 0.8 mm.

Between the outer edge 17 of the inlay 12 and a narrow is groove 22 that runs in a curved manner, concentrically with the outer edge extends an edge strip 23 that runs in an annular manner and that has the same width b over the entire strip region the same value as at the wide end of the crescent-shaped inlay 12, viewed in the sectional plane IIIa-IIIa, to about ⅙ of the total width $a_1$ of the inlay 12 and at the narrower end thereof, viewed in the sectional plane IIIb-IIIb, to about ⅓ of the total width $a_2$ (FIG. 3*b*) provided therein of the inlay 12.

The thickness $d_a$ has within this edge strip 23 the highest value ($d_a$=2.5 mm) and in the region of the groove 22 its smallest value ($d_i$=0.8 mm) to which the value of the thickness on the inner edge 18 of the inlay also corresponds.

In the crescent-shaped region 26 between the groove 22 and the inner edge 18 of the inlay 12, its thickness decreases constantly, and in the region adjoining the groove 22 the thickness has a value of about 2 mm, as may be seen from the sectional views of FIGS. 3*a* and 3*b*.

In the form of the inlay 12 prior to incorporation of the inlay 12 into the cup 11/*l* or 11/*r* for the shape-maintaining reinforcement thereof, the inlay is embodied, viewed in the direction of the axis of curvature running perpendicularly to the drawing plane of FIG. 2, as a part that is delimited in a planar manner and is embodied symmetrically with respect to the center plane 24 (FIGS. 3*a* and 3*b*) running, viewed in the use configuration of the inlay 12, between its—convexly arched—outer face of the crescent body and its—concave—inner face, facing the wearer, of the inlay 12. The grooves 22 are symmetrical with respect to this center plane 24.

As a result of the reduction in material thickness is provided in the region of these grooves 22, the inlay is easier to bend there, so that the edge strip 23 of the inlay can nestle against the bra wearer's thorax and the—more flexible—crescent-shaped region 26 that, in terms of thickness, decreases continuously toward the inner edge 18, of the inlay 12 can assume an angled course, following the body shape, relative to the comparatively rigid edge region 23, as schematically illustrated by FIG. 1.

In order further to increase the resilient pliability of the inlay 12 in its crescent-shaped region 26 extending between the groove 22 and the inner edge 18, the region is provided with numerous openings 27 that over most of the face are arranged in a uniform distribution and produce a material weakening promoting flexibility of the inlay in this region.

These openings 27 produce for the flexible, crescent-shaped region 26 a regular structure, joined together in the shape of a lattice, of the inlay 12 that, while maintaining high flexibility and suitability of the cup 11/*l, r* reinforced in this way for adaptation to the wearer's body shape, produces desirably good shape preservation of the cups 11/*l, r* of the bra 10.

Figure 4A:
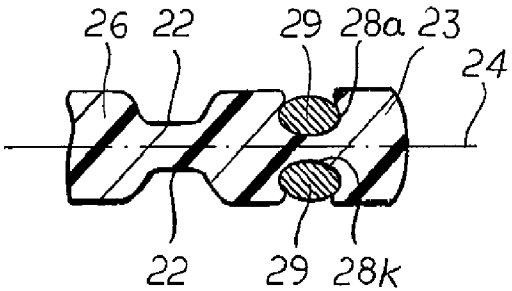
FIG. 4*a* is a partial sectional view of a further illustrated embodiment of an inlay according to the invention with reinforcing rings in section along a sectional plane corresponding to the line IVa-Iva of FIG. 2.
Figure 4B:
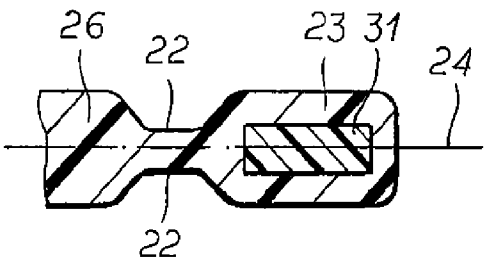
FIG. 4*b* shows a further illustrated embodiment that is functionally similar to the illustrated embodiment according to FIG. 4*a*, of an inlay according to the invention manufactured by injection-molding and having a sheathed reinforcing element.

To achieve good shape preservation of the bra cups 11/*l, r*, a reinforcing of the outer edge region 23 that can be implemented in a broad range of ways is provided in the embodiment of an inlay 12 according to FIGS. 4*a* and 4*b*.

Grooves 28/*h* and 28/*k*, into which reinforcing elements 29 that are wire-shaped or the edges of which have been smoothed in an equivalent manner can be inserted in a force-transmitting/form-fitting manner, are provided, in the case of the embodiment according to FIG. 4*a*, in a symmetrical arrangement with respect to the center plane 24 of the inlay 12. Depending on the degree of the desired rigidification, both grooves 28/*h* and 28/*k* or only one of them can be fitted with a reinforcing element.

For the above-described purpose of an edge reinforcing of the respective inlay, it is also possible, as illustrated schematically by FIG. 4*b*, to inject into the edge strip 23 a reinforcing element 31 that is made of plastics material or metal that is surrounded on all sides by plastics material of the inlay 12.

It will be understood that the edge strip 23 and the more flexible, crescent-shaped region 26 of the inlay 12 can span sectors of differing size of the cup edges, as is directly apparent for example from FIG. 1, selected for the purposes of description.

The invention claimed is:

1. An inlay for resiliently shape maintaining and stabilizing bra cups having regions directly engaging a wearer's thorax and intended to have higher rigidity than cup regions that encase the wearer's breasts and are of a convex/dome shape, the inlay being connected to a flexible textile material that forms the bra cups wherein the inlay is a pliably resilient plastics material part having the basic shape of a crescent with arcuate inner and outer edges that have a spacing that increases continuously between a minimum value at one end and a maximum value at an opposite end, a rigidity of the inlay decreases from the outer edge of the lower curvature to the inner edge of greater curvature, the inlay is manufactured flat such that a central crescent-shaped region running between the inner and outer edges lies in a plane, and d) the inlay is made of a material that is plastically deformable when heated for connection to the textile material of the cups.

2. The inlay according to claim 1 wherein the inlay is a one-piece part made of thermoplastic polymer and has a rigidity decreasing from the outer edge to the inner edge as a consequence of:

a) decrease in material thickness from the outer edge to the inner edge or b) provision of openings in a predetermined distribution, of a predetermined shape, or of a predetermined size.

3. The inlay according to claim 2 wherein the outer edge has an edge region that is strip-shaped and in which is integrated a stabilizing bow, and a film hinge between the edge region and the crescent-shaped region, whereby this strip-shaped edge region can fit against the wearer's thorax in use of the bra.

4. The inlay according to claim 3 wherein the edge region that can be placed against the wearer's thorax is of significantly higher rigidity than the crescent-shaped region of the inlay.

5. The inlay according to claim 4 wherein the bow is made of a more flexible material than the edge strip of the inlay.

6. The inlay according to claim 5 wherein the reinforced edge strip is formed with two arcuately curved grooves on opposite sides and into each of which a respective one of the reinforcing bows is fitted, the grooves receiving the two reinforcing bows being separated from each other by a thin partition.

7. The inlay according to claim 1 wherein one of a steel wire or a steel wire braid or a plastic bow is imbedded in the edge strip for reinforcement.

8. The inlay according to claim 1 wherein the inlay has an angular extent of at least 150° and at most 280°.

* * * * *